US009147522B2

(12) United States Patent
Takahashi et al.

(10) Patent No.: US 9,147,522 B2
(45) Date of Patent: Sep. 29, 2015

(54) IGNITION COIL FOR INTERNAL COMBUSTION ENGINE

(75) Inventors: Makio Takahashi, Hitachinaka (JP); Takanobu Kobayashi, Tokai (JP); Yoichi Anzo, Hitachinaka (JP); Gakuji Moriya, Utsunomiya (JP); Makoto Kurahashi, Utsunomiya (JP)

(73) Assignees: Hitachi Automotive Systems, Ltd., Hitachinaka-shi (JP); Honda Motor Co., Ltd., Tokyo (JP)

( * ) Notice: Subject to any disclaimer, the term of this patent is extended or adjusted under 35 U.S.C. 154(b) by 143 days.

(21) Appl. No.: 14/000,833

(22) PCT Filed: Mar. 2, 2012

(86) PCT No.: PCT/JP2012/055474

§ 371 (c)(1),
(2), (4) Date: Oct. 11, 2013

(87) PCT Pub. No.: WO2012/121177

PCT Pub. Date: Sep. 13, 2012

(65) Prior Publication Data

US 2014/0043717 A1 Feb. 13, 2014

(30) Foreign Application Priority Data

Mar. 4, 2011 (JP) ..... 2011-048043

(51) Int. Cl.
*F23Q 3/00* (2006.01)
*H01F 38/12* (2006.01)
(Continued)

(52) U.S. Cl.
CPC . *H01F 38/12* (2013.01); *F02P 3/02* (2013.01); *H01F 27/02* (2013.01); *F02P 13/00* (2013.01)

(58) Field of Classification Search
CPC ..... F23Q 3/00
USPC ..... 361/263
See application file for complete search history.

(56) References Cited

U.S. PATENT DOCUMENTS 5,487,676 A * 1/1996 Maruyama et al. ..... 439/125
5,618,193 A * 4/1997 Nakajima et al. ..... 439/125
(Continued)

FOREIGN PATENT DOCUMENTS

JP 9-158820 A 6/1997
JP 2006-242123 A 9/2006
(Continued)

OTHER PUBLICATIONS

International Preliminary Report on Patentability (PCTIB/338 & PCT/IB/373) dated Sep. 10, 2013, including English translation of previously submitted document C2 (PCT/ISA/237) dated May 29, 2012 (eight (8) pages).
(Continued)

*Primary Examiner* — Stephen W Jackson
(74) *Attorney, Agent, or Firm* — Crowell & Moring LLP

(57) ABSTRACT

An object of the present invention is to provide an ignition coil for use in an internal combustion engine, offering improved water drainage performance, while achieving high waterproof performance with controlled entry of water in a plug hole. A high-voltage generating section 3 that generates a high voltage is housed inside a coil case 4. A plug hole seal 5 closes an opening in a plug hole 2 in which an ignition plug 21 is mounted. The ignition coil further includes a space portion 6 placed on an outer side portion of the high-voltage generating section 3 and an air path 9 for venting air between the space portion 6 and the plug hole 2. The space portion 9 has an open lower surface (an entirely open surface facilitates demolding).

8 Claims, 7 Drawing Sheets

(51) Int. Cl.

| | |
|---|---|
| ***H01F 27/02*** | (2006.01) |
| ***F02P 3/02*** | (2006.01) |
| *F02P 13/00* | (2006.01) |

(56) References Cited

U.S. PATENT DOCUMENTS

| | | | | |
|---|---|---|---|---|
| 5,771,870 | A | 6/1998 | Satou et al. | |
| 8,528,533 | B2 * | 9/2013 | Kishi et al. | 123/635 |

FOREIGN PATENT DOCUMENTS

| | | | |
|---|---|---|---|
| JP | 2007-303401 | A | 11/2007 |
| JP | 2008-60188 | A | 3/2008 |
| JP | 2008-60228 | A | 3/2008 |

OTHER PUBLICATIONS

International Search Report dated May 29, 2012 w/ English translation (eight (8) pages).

Japanese-language Written Opinion (PCT/ISA/237) dated May 29, 2012 (five (5) pages).

* cited by examiner

IGNITION COIL FOR INTERNAL COMBUSTION ENGINE

TECHNICAL FIELD

The present invention relates to ignition coils for use in internal combustion engines, the ignition coils supplying high voltages for causing spark discharges to occur at ignition plugs of internal combustion engines. More specifically, the invention relates to an ignition coil for use in an internal combustion engine, suitable for waterproofing of a plug hole.

BACKGROUND ART

In conventional ignition coils for use in internal combustion engines, the inside of a plug hole communicates with an outside atmospheric pressure side via an air path disposed at a boundary between an outer periphery of the ignition coil and a plug hole seal. This is done to discharge/take air from/to the inside of the plug hole to facilitate removal of the ignition coil, the air being produced when the temperature inside the plug hole changes or the ignition coil is removed or reinstalled. A change in ambient temperature or the internal combustion engine being splashed with water, however, causes the temperature of the plug hole to be reduced, resulting in a change in pressure inside the plug hole. Thus, to achieve equilibrium with the outside air, a negative pressure is created to draw the outside air in. Then, the negative pressure may cause water to enter the plug hole from the outside via an opening in the air path on the atmospheric side.

A known arrangement includes a pool section (water retention chamber) for storing therein water that enters the air path (see, for example, Patent Document 1). Water entering from the outside is retained in the pool section and thus prevented from entering the plug hole.

PRIOR ART LITERATURE

Patent Document

Patent Document 1: JP-2008-60228-A

SUMMARY OF THE INVENTION

Problem to be Solved by the Invention

The arrangement disclosed in Patent Document 1 has a small air path (vent port) formed at a position before (on the atmospheric side) the pool section for storing therein water, in order to ensure that water enters the pool section less easily. The structure makes water less easy to enter the pool section because of the small air path on the one hand; on the other hand, it makes water once in the pool section less easy to be discharged therefrom. Under repetitive environmental conditions in which the ignition coil is temporarily totally submerged in water, therefore, the related-art arrangement, while achieving high waterproof performance with controlled entry of water in the plug hole, offers only poor water drainage performance and may cause water held in the pool section to enter the plug hole.

It is an object of the present invention to provide an ignition coil for use in an internal combustion engine, offering improved water drainage performance, while achieving high waterproof performance with controlled entry of water in a plug hole.

Means for Solving the Problem (1) To achieve the foregoing object, an aspect of the present invention provides an ignition coil for an internal combustion engine. The ignition coil includes: a coil section for generating a high voltage; a coil case for housing therein the coil section; a plug hole seal for closing an opening in a plug hole in which an ignition plug is disposed; a space portion divided by an outer peripheral wall disposed on an outer side portion of the coil case; and an air path for venting air between the space portion and the plug hole. The space portion is connected, at a first end portion thereof on a side opposite to a side of a second end portion thereof on which the ignition plug is connected, via a small hole to a first end of the air path having a second end communicating with the plug hole, and the second end portion of the space portion on the side on which the ignition plug is connected is open to an atmosphere through an opening having a path area larger than a path area of the small hole.

Such arrangements can improve water drainage performance, while achieving high waterproof performance with controlled entry of water in the plug hole.

(2) In the arrangements of (1) above, preferably, the space portion and the air path are formed integrally with the coil case. The ignition coil further includes a sealing member for sealing the first end portion of the space portion on the side opposite to the side of the second end portion on which the ignition plug is connected, the sealing member forming part of the air path connecting the plug hole to the space portion via the small hole.

(3) In the arrangements of (1) above, preferably, the air path is formed integrally with the coil case, and the space portion is formed by a side case fixed afterwards to the coil case.

(4) In the arrangements of (1) above, preferably, the air path is disposed within a central ⅓ portion in a width direction of the space portion.

(5) In the arrangements of (2) above, preferably, the space portion has the small hole formed, at the first end portion on the side opposite to the side of the second end portion on which the ignition plug is connected, to extend in a direction in which the ignition plug is inserted into the plug hole, the sealing member for covering the air path and the small hole forms a horizontal path connecting the air path and the small hole, and the air path extends in a direction in which the ignition coil is inserted into the plug hole and has an end portion connected to the plug hole.

(6) In the arrangements of (2) above, preferably, the air path has a stepped or tapered portion at a connection to the small hole to thereby have a cross-sectional area larger than a cross-sectional area of the small hole.

(7) In the arrangements of (2) above, preferably, a protrusion is formed of the coil case to protrude toward the sealing member at an intermediate horizontal portion which is formed at the stepped or tapered portion of the air path.

(8) In the arrangements of (1) above, preferably, a portion around a connection of the air path to the plug hole has a protrusion formed integrally with the coil case to extend toward the side opposite to the side on which the ignition plug is connected.

(9) In the arrangements of (1) above, preferably, the outer peripheral wall for forming the space portion has a protrusion protruding from the outer peripheral wall so as to cover an area around the opening in the space portion.

Effect of the Invention

The aspect of the present invention can improve water drainage performance, while achieving high waterproof performance with controlled entry of water in the plug hole.

MODES FOR CARRYING OUT THE INVENTION

Arrangements of an ignition coil for use in an internal combustion engine according to a first embodiment of the present invention will be described below with reference to FIGS. 1 to 3.

Figure 1:
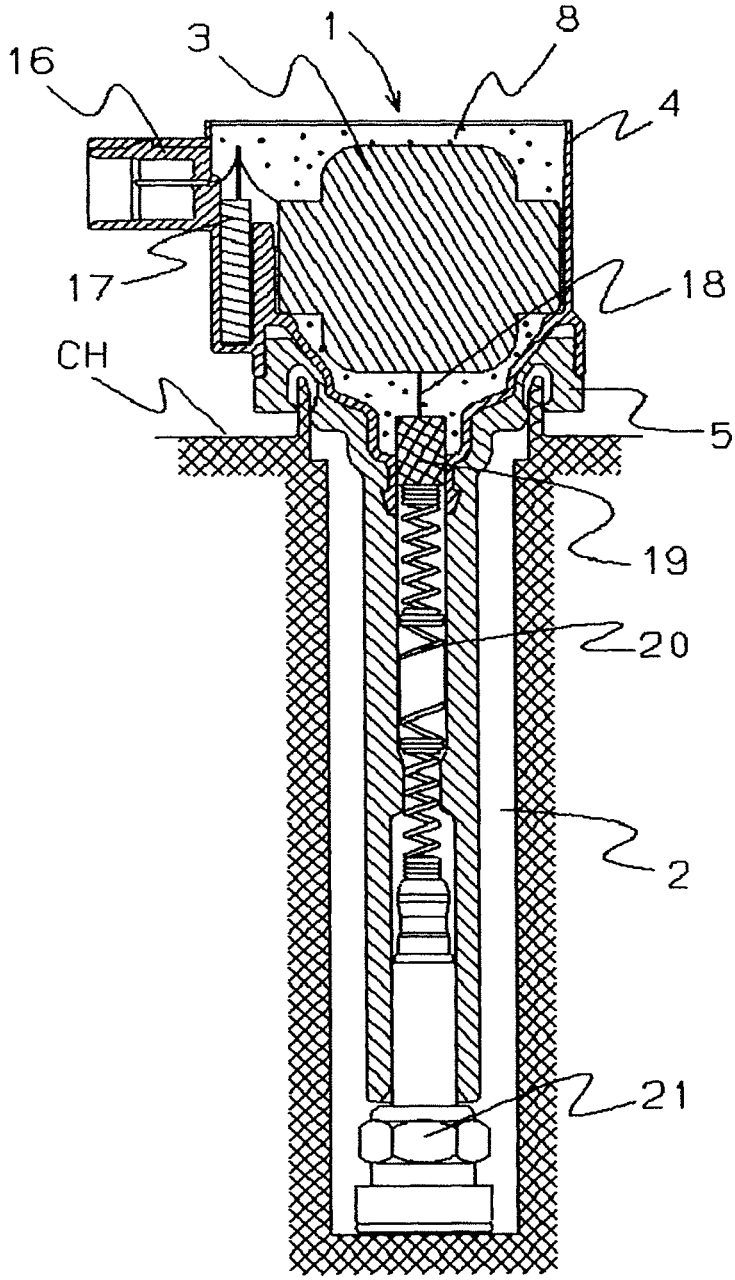
FIG. 1 is a cross-sectional view showing arrangements of an ignition coil for use in an internal combustion engine according to a first embodiment of the present invention.

FIG. 1 is a cross-sectional view showing arrangements of the ignition coil for use in an internal combustion engine according to the first embodiment of the present invention. FIG. 2 is another cross-sectional view of the ignition coil shown in FIG. 1. FIG. 3 is a cross-sectional view taken along line A-A of FIG. 2.

In FIG. 1, an internal combustion engine ignition coil 1 is an independent ignition type mounted in a plug hole 2 of each cylinder formed in a cylinder head of an internal combustion engine and directly coupled to an ignition plug 21. The internal combustion engine ignition coil 1 includes a connector 16. An external battery supplies electric power to an igniter 17 or a coil section 3 inside the internal combustion engine ignition coil 1 via an internal terminal of the connector 16. An external engine control unit (ECU) supplies an ignition signal to the igniter 17 inside the internal combustion engine ignition coil 1.

The ignition coil 1 includes the igniter 17 that operates according to an ignition signal from the ECU, the coil section 3, a coil case 4, and a plug hole seal 5. The coil section 3 includes, for example, a primary coil, a secondary coil, and a laminated core and generates a high voltage. The coil case 4 formed of a thermoplastic resin houses therein the igniter 17 and the coil section 3. The plug hole seal 5 is disposed between the coil case 4 and the plug hole 2 to thereby close an opening in the plug hole 2.

The plug hole 2 is formed in a cylinder head CH of the internal combustion engine for each cylinder. The ignition plug 21 is screwed into the cylinder head CH at a lower portion of the plug hole 2.

The coil case 4 has a lower portion sealed with a metal terminal 19. The coil section 3 is inserted in the coil case 4. A pin 18 is fixed in a secondary bobbin of the coil section 3 and connected to the secondary coil. The pin 18 is formed, for example, of phosphor bronze and has a spring property. With the coil section 3 inserted in the coil case 4, the pin 18 has an end portion in contact with the terminal 19 and is conductive because of its spring property. An insulating resin 8, such as an epoxy resin, is packed inside the coil case 4 to thereby seal the igniter 17 and the coil section 3.

The plug hole seal 5 is attached to the lower portion of the coil case 4. The plug hole seal 5 is formed of, for example, silicone rubber. The plug hole seal 5 extends in a cylindrical shape downwardly in the figure and is inserted in an electrode terminal at an upper portion of the ignition plug 21. A metal spring 20 is inserted inside the cylindrical space in the plug hole seal 5. The metal spring 20 thereby conducts electrically the terminal 19 with the electrode terminal at the upper portion of the ignition plug 21, so that a high voltage pulse generated at the coil section 3 can be supplied to the ignition plug 21.

Figure 2:
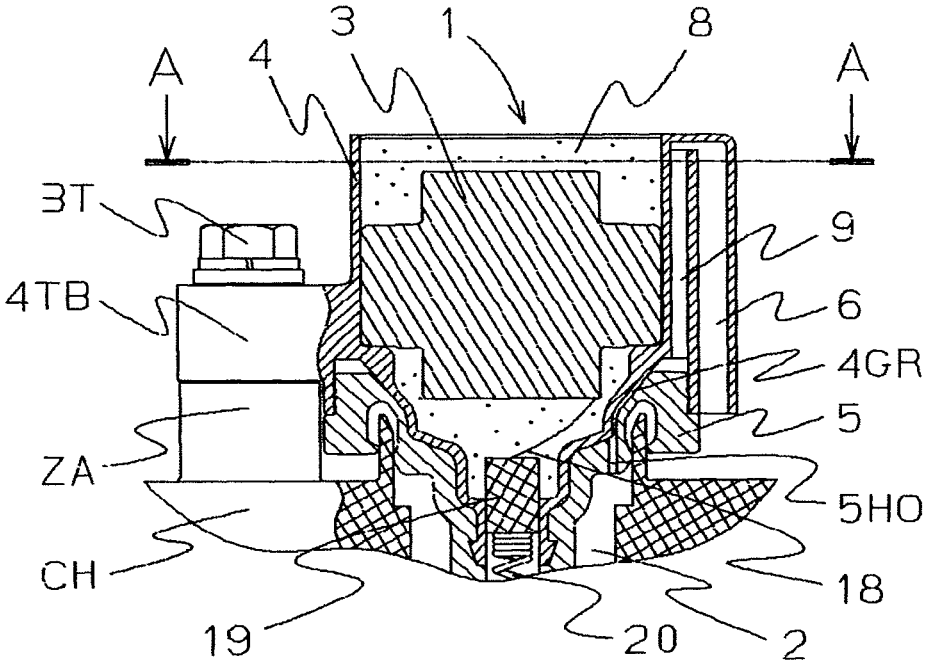
FIG. 2 is another cross-sectional view of the ignition coil shown in FIG. 1.
Figure 3:
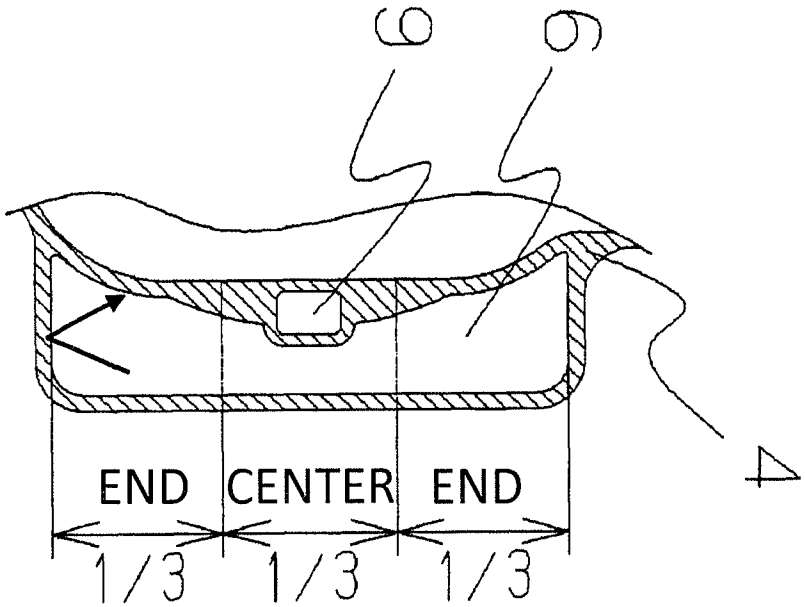
FIG. 3 is a cross-sectional view taken along line A-A of FIG. 2.

As shown in FIG. 2, a mounting portion 4TB is integrally formed with a side portion of the coil case 4. Meanwhile, a mounting seat ZA is integrally formed with the cylinder head CH at an upper portion of the cylinder head CH. The mounting portion 4TB is fixed to the mounting seat ZA with, for example, a bolt BT, so that the ignition coil 1 is fixed to the upper portion of the cylinder head CH.

A space portion 6 and an air path 9 are integrally formed on an outer side portion on the right in the figure of the coil case 4. The space portion 6 is divided by an outer peripheral wall disposed on the outer side of the coil case 4. The space portion 6 and the air path 9 communicate with each other at upper portions thereof. Specifically, the space portion 6 is connected to an upper end portion of the air path 9 through a small hole at an end portion on a side opposite to a side on which the ignition plug is connected. The term "small hole", as used herein, refers to a rectangular hole denoted by reference numeral 9 in FIG. 3. The space portion 6 is shaped like a glass turned upside down to have an "open" lower surface (an entirely open surface facilitates demolding). As will be described later with reference to FIG. 3, the space portion 6 is a path having a cross-sectional area larger than that of the air path 9. Specifically, the space portion 6 has an end portion on the side on which the ignition plug is connected, the end portion being open to the atmosphere through an opening having a larger path area than the abovementioned small hole.

The plug hole seal 5 has a small through hole 5HO formed therein. The coil case 4 has an outer surface having a groove portion 4GR formed therein. With the plug hole seal 5 mounted on the lower portion of the coil case 4, the groove portion 4GR has an upper portion communicating with the air path 9 and a lower portion communicating with the through hole 5HO in the plug hole seal 5. Though being a tiny groove that is, for example, 0.8 mm wide and 0.4 mm deep, the groove portion 4GR maintains a groove form capable of communicating between the air path 9 and the through hole 4HO even with the plug hole seal 5 mounted on the lower portion of the coil case 4. In a condition in which the ignition coil 1 is fixed on the upper portion of the cylinder head CH, the through hole 5HO communicates with the plug hole 2.

Thus, a vent path between the plug hole 2 and the outside air is in order of the space portion 6, the air path 9, the groove portion 4GR, the through hole 5HO, and the plug hole 2.

If the ignition coil 1 is splashed with water and totally submerged in water temporarily, the cylinder head CH is cooled to reduce a temperature of the plug hole 2. Because of a resultant change in pressure inside the plug hole 2, a negative pressure is created to draw outside air in to thereby achieve equilibrium. This negative pressure causes water to attempt to enter the plug hole 2; however, the space portion 6, being shaped like a glass turned upside down, retains air thereinside even with the ignition coil 1 totally submerged in water. By having a volume of the space portion 6 larger than a volume contracted as a result of the temperature change in the plug hole, a level of water inside the space portion 6 does not increase up to an inlet (the upper portion of the air path 9) of the air path 9 that is connected to the plug hole, so that no water enters the plug hole. The space portion 6 has a volume of, for example, 4 cc. Meanwhile, the plug hole 2 has a volume of about 40 cc. The volume of the plug hole contracted as a result of the temperature change is, in this case, about 2 cc and thus the volume of the space portion 6 is larger than the contracted volume (2 cc).

The space portion 6 has the "open" lower surface (the entirely open surface facilitates demolding). If the water level around the ignition coil 1 is equal to, or lower than, the lower surface of the space portion 6, therefore, water drawn up into the space portion 6 by a negative pressure created in the plug hole is instantaneously discharged, which results in improved water drainage performance. Consequently, even under repetitive environmental conditions in which the ignition coil 1 is totally submerged in water temporarily, entry of water in the plug hole can be prevented.

If a vehicle moves with water retained in the space portion 6, the water inside the space portion 6 moves and splashes. By setting the air path 9 within a central ⅓ portion in a width direction of the space portion 6 as shown in FIG. 3, however, the splashed water can be prevented from easily entering the air path 9. The water splashes to follow a path as indicated by an arrow in FIG. 3. The arrow path is oriented from a lower portion of the space portion 6 toward an upper portion thereof. Water, if hitting and splashing against a short side wall of the space portion 6, flies onto positions away from the central portion of the space portion 6, so that the splashed water can be prevented from easily entering the air path 9 by setting the air path 9 within a central ⅓ portion in the space portion 6.

As described heretofore, even under repetitive environmental conditions in which the ignition coil is totally submerged in water temporarily, the arrangements according to the present embodiment achieve high waterproof performance with controlled entry of water in the plug hole and offer high water drainage performance because of the open lower surface (the entirely open surface facilitates demolding) of the space portion on a side of the coil.

Arrangements of an ignition coil for use in an internal combustion engine according to a second embodiment of the present invention will be described below with reference to FIG. 4.

Figure 4:
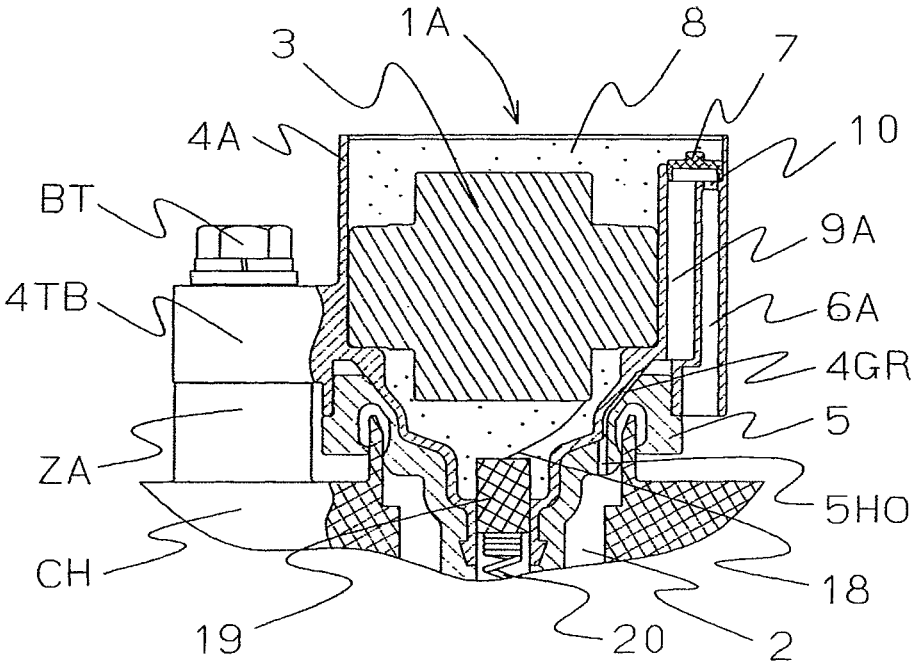
FIG. 4 is a cross-sectional view showing arrangements of an ignition coil for use in an internal combustion engine according to a second embodiment of the present invention.

FIG. 4 is a cross-sectional view showing arrangements of the ignition coil for use in an internal combustion engine according to the second embodiment of the present invention. Like parts are identified by the same reference numerals as those used in FIGS. 1 to 3.

In the present embodiment, a coil case 4A used for an ignition coil 1A is shaped differently from the coil case 4 shown in FIG. 2 in the following points. Specifically, the coil case 4A forms a space portion 6A and an air path 9A. The space portion 6A has an air path inlet (small hole) 10 formed at an upper portion thereof. The air path inlet 10 and the air path 9A each have an open upper portion. This opening (the opening on an end portion of the space portion on a side opposite to a side on which an ignition plug is connected) is sealed with a sealing member 7 formed of an elastic material. The sealing member 7 has an upper portion cast in an insulating resin 8. The sealing member 7 forms part of the air path 9A that connects a plug hole and the space portion 6A via the abovementioned small hole (air path inlet 10). The air path 9A is formed so as to extend from the space portion 6A vertically upwardly, then horizontally, and finally vertically downwardly. Specifically, the sealing member 7 that covers the air path 9A and the small hole (air path inlet 10) forms a horizontal path that connects the air path 9A and the small hole (air path inlet 10). The air path 9A extends in a direction in which the ignition coil is inserted into the plug hole and has an end portion connected to the plug hole 2. Other arrangements are the same as those shown in FIGS. 1 to 3.

Even under repetitive environmental conditions in which the ignition coil is totally submerged in water temporarily, the arrangements according to the present embodiment also achieve high waterproof performance with controlled entry of water in the plug hole and offer high water drainage performance because of the open lower surface (the entirely open surface facilitates demolding) of the space portion on a side of the coil.

Arrangements of an ignition coil for use in an internal combustion engine according to a third embodiment of the present invention will be described below with reference to FIG. 5.

Figure 5:
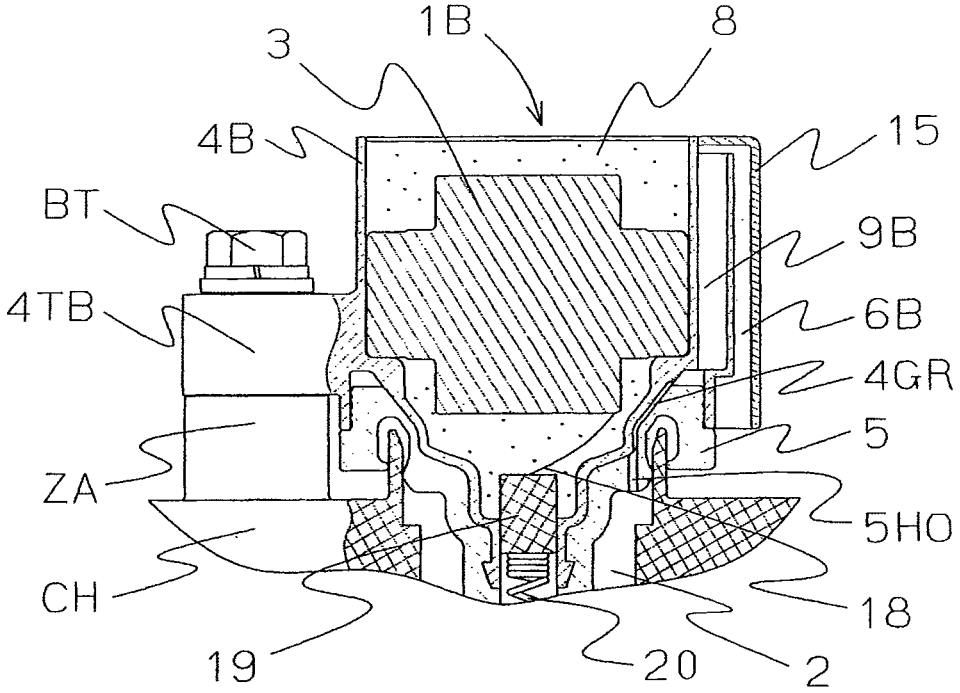
FIG. 5 is a cross-sectional view showing arrangements of an ignition coil for use in an internal combustion engine according to a third embodiment of the present invention.

FIG. 5 is a cross-sectional view showing arrangements of the ignition coil for use in an internal combustion engine according to the third embodiment of the present invention. Like parts are identified by the same reference numerals as those used in FIGS. 1 to 3.

In the present embodiment, a coil case 4B used for an ignition coil 1B is shaped differently from the coil case 4 shown in FIG. 2 in the following points. Specifically, while the coil case 4B forms a space portion 6, a side case 15 separate from the coil case 4B is tightly fixed afterwards to the coil case 4B through, for example, bonding, to thereby form a space portion 6B. This makes the space portion 6B having an even larger volume. Other arrangements are the same as those shown in FIGS. 1 to 3.

Even under repetitive environmental conditions in which the ignition coil is totally submerged in water temporarily, the arrangements according to the present embodiment also achieve high waterproof performance with controlled entry of water in the plug hole and offer high water drainage performance because of the open lower surface (the entirely open surface facilitates demolding) of the space portion on a side of the coil.

Arrangements of an ignition coil for use in an internal combustion engine according to a fourth embodiment of the present invention will be described below with reference to FIG. 6.

Figure 6:
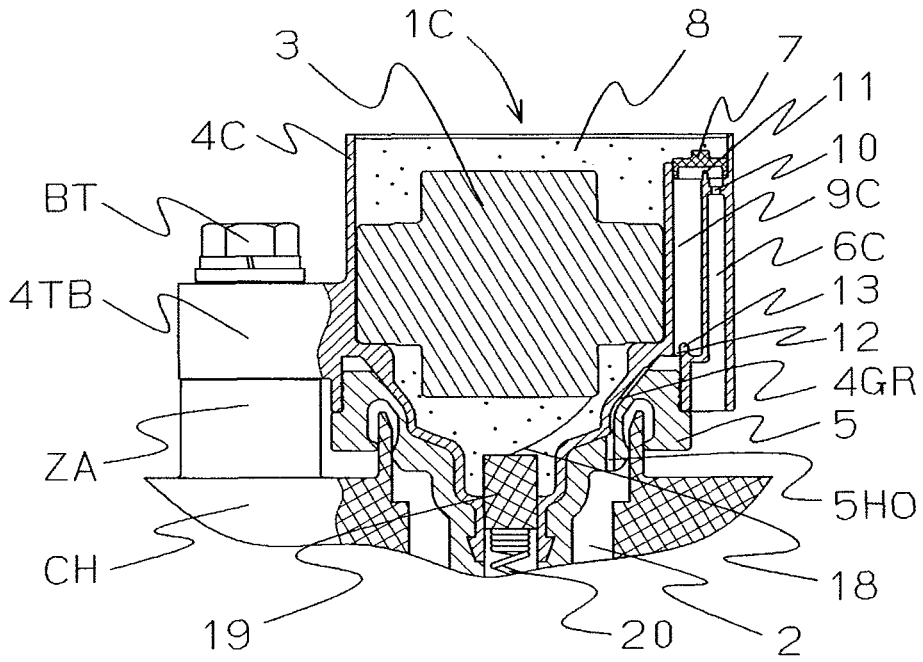
FIG. 6 is a cross-sectional view showing arrangements of an ignition coil for use in an internal combustion engine according to a fourth embodiment of the present invention.

FIG. 6 is a cross-sectional view showing arrangements of the ignition coil for use in an internal combustion engine according to the fourth embodiment of the present invention. Like parts are identified by the same reference numerals as those used in FIGS. 1 to 4.

In the present embodiment, a coil case 4C used for an ignition coil 1C is shaped differently from the coil case 4 shown in FIG. 2 in the following points. Specifically, the coil case 4C forms a space portion 6C and an air path 9C. The space portion 6C has an air path inlet (small hole) 10 formed at an upper portion thereof. The air path inlet 10 and the air path 9C each have an open upper portion. In addition, the air path inlet 10 is stepped. Should a negative pressure be created in the plug hole with water droplets affixed to the air path inlet 10, the water droplets go up above the air path inlet 10; as the water droplets go up, the air path cross-sectional area increases, causing the water droplets to be thin and eventually drop. Instead of being stepped, the air path inlet 10 may be tapered.

The coil case 4C forms a protrusion 11 extending upwardly at an intermediate horizontal portion of the air path. The protrusion 11 functions as an elevated breakwater to prevent water from climbing over easily. The protrusion 11 protrudes toward a sealing member 7.

The abovementioned opening is sealed with the sealing member 7 formed of an elastic material. The sealing member 7 has an upper portion cast in an insulating resin 8. The air path 9B is formed so as to extend from the space portion 6B vertically upwardly, then horizontally, and finally vertically downwardly.

A protrusion 13 is disposed around an outlet 12 at a lower portion of the air path 9C. This makes a zone in which water can be held, so that water can be prevented from easily entering the outlet 12 of the air path. The protrusion 13 is disposed around a connection of the air path 9C to the plug hole and formed integrally with the coil case. Additionally, the protrusion 13 protrudes in a direction opposite to the side on which the ignition plug is connected. Other arrangements are the same as those shown in FIGS. 1 to 3.

Even under repetitive environmental conditions in which the ignition coil is totally submerged in water temporarily, the arrangements according to the present embodiment also achieve high waterproof performance with controlled entry of water in the plug hole and offer high water drainage performance because of the open lower surface (the entirely open surface facilitates demolding) of the space portion on a side of the coil.

Arrangements of an ignition coil for use in an internal combustion engine according to a fifth embodiment of the present invention will be described below with reference to FIG. 7.

Figure 7:
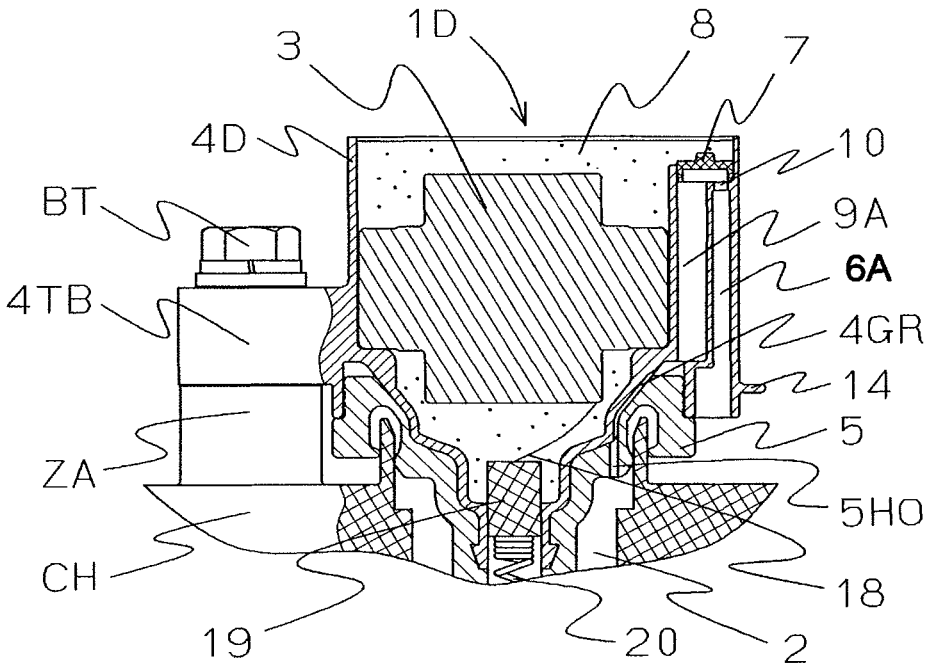
FIG. 7 is a cross-sectional view showing arrangements of an ignition coil for use in an internal combustion engine according to a fifth embodiment of the present invention.

FIG. 7 is a cross-sectional view showing arrangements of the ignition coil for use in an internal combustion engine according to the fifth embodiment of the present invention. Like parts are identified by the same reference numerals as those used in FIGS. 1 to 4.

In the present embodiment, a coil case 4D used for an ignition coil 1D is shaped differently from the coil case 4A shown in FIG. 4 in the following points. Specifically, an outer peripheral wall that forms a space portion 6A of the coil case 4D has a protrusion 14 extending in a perpendicular direction. The protrusion 14 protrudes from the outer peripheral wall for forming the space portion 6A so as to cover an area around an opening in the space portion 6A. Should the ignition coil 1D be splashed with water under high pressure during high-pressure washing, the protrusion 14 prevents water from gathering at the underside of the space portion 6A, thus adequately controlling entry of water from the open lower surface. The protrusion 14 may be high enough to be disposed on the outer peripheral wall.

Even under repetitive environmental conditions in which the ignition coil is totally submerged in water temporarily, the arrangements according to the present embodiment also achieve high waterproof performance with controlled entry of water in the plug hole and offer high water drainage performance because of the open lower surface (the entirely open surface facilitates demolding) of the space portion on a side of the coil.

It is noted that the present invention is directed to both what-is-called a plug top type ignition coil having the coil section at the upper portion of the plug hole and what-is-called a plug hole type ignition coil having the coil section inside the plug hole.

DESCRIPTION OF REFERENCE NUMERALS

1 Ignition coil for internal combustion engine
2 Plug hole
3 Coil section
4 Coil case
5 Plug hole seal
6 Space portion
7 Sealing member
8 Insulating resin
9 Air path
10 Air path inlet
11 Protrusion at air path horizontal section
12 Air path outlet
13 Protrusion near air path outlet
14 Protrusion extending perpendicularly from outer peripheral wall
15 Side case
16 Connector
17 Igniter
18 Pin
19 Terminal
20 Spring
21 Ignition plug

The invention claimed is:

1. An ignition coil for an internal combustion engine, the ignition coil comprising:
- a coil section for generating a high voltage;
- a coil case for housing therein the coil section;
- a plug hole seal for closing an opening in a plug hole in which an ignition plug is disposed;
- a space portion divided by an outer peripheral wall disposed on an outer side portion of the coil case; and
- an air path for venting air between the space portion and the plug hole, wherein
  - the space portion is connected, at a first end portion thereof on a side opposite to a side of a second end portion thereof on which the ignition plug is connected, via a small hole to a first end of the air path having a second end communicating with the plug hole,
  - the second end portion of the space portion on the side on which the ignition plug is connected is open to an atmosphere through an opening having a path area larger than a path area of the small hole, and
  - the air path is disposed within a central ⅓ portion in a width direction of the space portion.

2. The ignition coil for an internal combustion engine according to claim 1, wherein the space portion and the air path are formed integrally with the coil case, the ignition coil further comprising:
- a sealing member for sealing the first end portion of the space portion on the side opposite to the side of the second end portion on which the ignition plug is connected, the sealing member forming part of the air path connecting the plug hole to the space portion via the small hole.

3. The ignition coil for an internal combustion engine according to claim 1, wherein
- the air path is formed integrally with the coil case, and
- the space portion is formed by a side case fixed afterwards to the coil case.

4. The ignition coil for an internal combustion engine according to claim 1, wherein
- a portion around a connection of the air path to the plug hole has a protrusion formed integrally with the coil case to extend toward the side opposite to the side on which the ignition plug is connected.

5. The ignition coil for an internal combustion engine according to claim 1, wherein
- the outer peripheral wall for forming the space portion has a protrusion protruding from the outer peripheral wall so as to cover an area around the opening in the space portion.

6. An ignition coil for an internal combustion engine, the ignition coil comprising:

a coil section for generating a high voltage;

a coil case for housing therein the coil section;

a plug hole seal for closing an opening in a plug hole in which an ignition plug is disposed;

a space portion divided by an outer peripheral wall disposed on an outer side portion of the coil case; and an air path for venting air between the space portion and the plug hole, wherein the space portion is connected, at a first end portion thereof on a side opposite to a side of a second end portion thereof on which the ignition plug is connected, via a small hole to a first end of the air path having a second end communicating with the plug hole, the second end portion of the space portion on the side on which the ignition plug is connected is open to an atmosphere through an opening having a path area larger than a path area of the small hole, the space portion and the air path are formed integrally with the coil case, the ignition coil further comprising:

a sealing member for sealing the first end portion of the space portion on the side opposite to the side of the second end portion on which the ignition plug is connected, the sealing member forming part of the air path connecting the plug hole to the space portion via the small hole, the space portion has the small hole formed, at the first end portion on the side opposite to the side of the second end portion on which the ignition plug is connected, to extend in a direction in which the ignition plug is inserted into the plug hole, the sealing member for covering the air path and the small hole forms a horizontal path connecting the air path and the small hole, and the air path extends in a direction in which the ignition coil is inserted into the plug hole and has an end portion connected to the plug hole.

7. An ignition coil for an internal combustion engine, the ignition coil comprising:

a coil section for generating a high voltage;

a coil case for housing therein the coil section;

a plug hole seal for closing an opening in a plug hole in which an ignition plug is disposed;

a space portion divided by an outer peripheral wall disposed on an outer side portion of the coil case; and an air path for venting air between the space portion and the plug hole, wherein the space portion is connected, at a first end portion thereof on a side opposite to a side of a second end portion thereof on which the ignition plug is connected, via a small hole to a first end of the air path having a second end communicating with the plug hole, the second end portion of the space portion on the side on which the ignition plug is connected is open to an atmosphere through an opening having a path area larger than a path area of the small hole, the space portion and the air path are formed integrally with the coil case, the ignition coil further comprising:

a sealing member for sealing the first end portion of the space portion on the side opposite to the side of the second end portion on which the ignition plug is connected, the sealing member forming part of the air path connecting the plug hole to the space portion via the small hole, and the air path has a stepped or tapered portion at a connection to the small hole to thereby have a cross-sectional area larger than a cross-sectional area of the small hole.

8. The ignition coil for an internal combustion engine according to claim 7, wherein a protrusion is formed of the coil case to protrude toward the sealing member at an intermediate horizontal portion which is formed at the stepped or tapered portion of the air path.

* * * * *